United States Patent [19]

Steiner et al.

[11] 4,158,923

[45] Jun. 26, 1979

[54] ROADWAY SNOW EXCAVATOR

[75] Inventors: Marvin B. Steiner; Roy I. Steiner, both of Orrville, Ohio

[73] Assignee: Steiner Corporation, Orrville, Ohio

[21] Appl. No.: 887,059

[22] Filed: Mar. 16, 1978

[51] Int. Cl.[2] ..... E01H 5/00

[52] U.S. Cl. ..... 37/43 D; 193/2 A

[58] Field of Search ..... 37/43 R, 43 A, 43 B, 37/43 C, 43 D, 43 E, 43 F, 43 G–43 H, 43 K, 41, 46–50; 193/2 R, 2 A, 22

[56] References Cited

U.S. PATENT DOCUMENTS

| | | | |
|---|---|---|---|
| 2,143,699 | 1/1939 | Jensen | 37/43 D |
| 2,337,108 | 12/1943 | Jensen | 37/43 D |
| 2,706,864 | 4/1955 | Kear | 37/43 R |
| 3,045,369 | 7/1962 | Howe, Jr. | 37/43 E |
| 3,429,061 | 2/1969 | Haban | 37/43 E |
| 3,583,084 | 6/1971 | Farrell | 37/43 E |
| 3,805,421 | 4/1974 | Kamlukin | 37/43 D |

FOREIGN PATENT DOCUMENTS

| | | | |
|---|---|---|---|
| 611158 | 12/1960 | Canada | 37/43 E |
| 2223386 | 6/1973 | Fed. Rep. of Germany | 37/43 D |

*Primary Examiner*—E. H. Eickholt

*Attorney, Agent, or Firm*—Mack D. Cook, II

[57] ABSTRACT

An apparatus, carried by a vehicle, for excavating packed snow or ice from a roadway in a swath equivalent to the width of the apparatus. A strong and unitary frame carries a transmission actuated by a vehicle PTO to power an axle shaft. The frame houses a hopper-like collector assembly with a chamber bisected by a paddle assembly on the axle shaft. The collector and paddle assemblies cooperate to slowly move snow or ice into a vertically oriented chute. Thereafter, the paddle assembly and vertical chute cooperate to rapidly propel snow or ice through a directional discharge chute. The apparatus may have one or more combinations of operative components to determine width of the snow or ice removal swath.

8 Claims, 8 Drawing Figures

ROADWAY SNOW EXCAVATOR

BACKGROUND OF THE INVENTION

The invention relates to a roadway snow excavation or removal apparatus. More particularly, the invention relates to an apparatus having a frame and operating components which may be selectively attached, quickly mounted or demounted, on either the rear or front of a vehicle having an appropriate power take-off unit. Alternatively, the apparatus could be carried by a vehicle devoted exclusively thereto.

Vehicle attached roadway snow excavators, snowplows or snow-removing apparatus are not new. Many types having various features and constructions are now in use. Prior art relevant to the invention may be found in Class 37, Excavating; subclasses 41, 43, 43 B, 43 D, 43 H, 44, 46–50, concerned with roadway snow excavators. The prior patent art has been reviewed and U.S. Pat. No. Re. 15,975, January/1925, Johnson; U.S. Pat. No. 1,524,518, January/1925, Jensen; U.S. Pat. No. 2,143,699, January/1939, Jensen; U.S. Pat. No. 2,224,870, December/1940, Jensen; U.S. Pat. No. 2,474,840, July/1949, Greer; and U.S. Pat. No. 2,880,527, April/1959, Merry, have been selected as the most pertinent prior art.

The snow excavation or removal apparatus has greater utility and many advantages over the prior art roadway snow excavators, snowplows or snow-removing apparatus. The apparatus was primarily conceived to deal with large banks of packed snow or ice created by severe blizzards, with high winds and drifting snow. The apparatus is particularly suited for use in rural areas, on unimproved lanes or county roads, where conventional blade-type snow plowing equipment is either late in arriving or ineffective, or both. When dealing with the aftermath of a blizzard, the apparatus has the capability of being attached to a farm tractor and used to slowly and powerfully open a track or path out to the main road. However, the apparatus may also be used to clear normal amounts of snow on expressways or airport runways, at relatively high vehicle speeds.

SUMMARY OF THE INVENTION

It is an object of the invention to provide improved apparatus, carried by a vehicle, for excavating packed snow or ice from an unimproved roadway in a swath equivalent to the width of the apparatus.

It is a further object of the invention to provide an apparatus having a strong frame and powerful components which may be selectively attached, quickly mounted or demounted, on either the rear or front of a vehicle having an appropriately positioned power take-off unit (or PTO).

Still further, it is an object of the invention to provide roadway snow or ice excavation apparatus which will effectively deal with the aftermath of a severe blizzard, with high winds and drifting snow, and also be capable of use to remove a normal snowfall.

These and other objects of the invention, and the advantages thereof, will be apparent in view of the description of a preferred embodiment, as set forth below.

In general, a roadway snow or ice excavation apparatus according to the invention is intended to be carried by a vehicle having an appropriate power take-off unit (PTO). The apparatus has a frame and operating components including a power transmission system for connection to the PTO and powering at least one axle shaft. The apparatus frame houses thereon at least one collector assembly having a vertically oriented hopper-like configuration with a wide and open face and a narrow discharge passage. A concentration chamber for snow or ice within the collector assembly is defined by an upper cover plate and dual side plates providing substantially planar walls converging on the discharge passage. The powered axle shaft projects into the concentration chamber through one of the collector assembly side plates and carries thereon a paddle assembly which when rotating functionally bisects the concentration chamber in a cylindrical and vertically oriented plane. A paddle assembly has scoops thereon shaped to provide radially oriented surfaces of sufficient length and width as to move snow or ice through the collector assembly discharge passage and into a vertically oriented chute carried on the apparatus frame. The vertically oriented chute has an open upper end and parallel sides and a rear wall interconnected to define an elongated conduit communicating with the collector assembly discharge passage and the open upper end. The lower portion of the chute conduit has a width slightly in excess of the effective width of the scoops on a paddle assembly. The rear wall of the vertically oriented chute has an air inlet positioned adjacent the point where snow or ice on the rotating paddle assembly becomes tangentially propelled. The rear wall of the vertically oriented chute further has a curved plate with a lower portion projecting toward the collector assembly and an upper portion positioned to define an edge of the air slot. The radius of the curved plate is slightly eccentric to the effective diameter of the rotating scoops of the paddle assembly and the curved plate is positioned so as to define the plane of a cylindrical surface gradually converging toward the effective diameter of the paddle scoops.

In the preferred embodiment of the invention as disclosed, the apparatus has dual powered axle shafts, dual collector assemblies, dual paddle assemblies, and dual axially oriented chutes. This form is particularly well suited to excavate packed snow or ice from a roadway in a swath wide enough for passage of a conventional vehicle. However, the subject matter of the invention could also be embodied in an apparatus having only one group, or more than two groups, of operative components.

The open upper end of a vertically oriented chute may communicate with a directional discharge chute assembly. Alternatively, the open upper chute end may be suitably adapted to communicate with a conveying system for receiving and temporarily storing the mass of snow or ice taken up from the roadway; a conveying system designed for use on an urban or city street roadway.

DETAILED DESCRIPTION OF THE INVENTION

Figure 1:
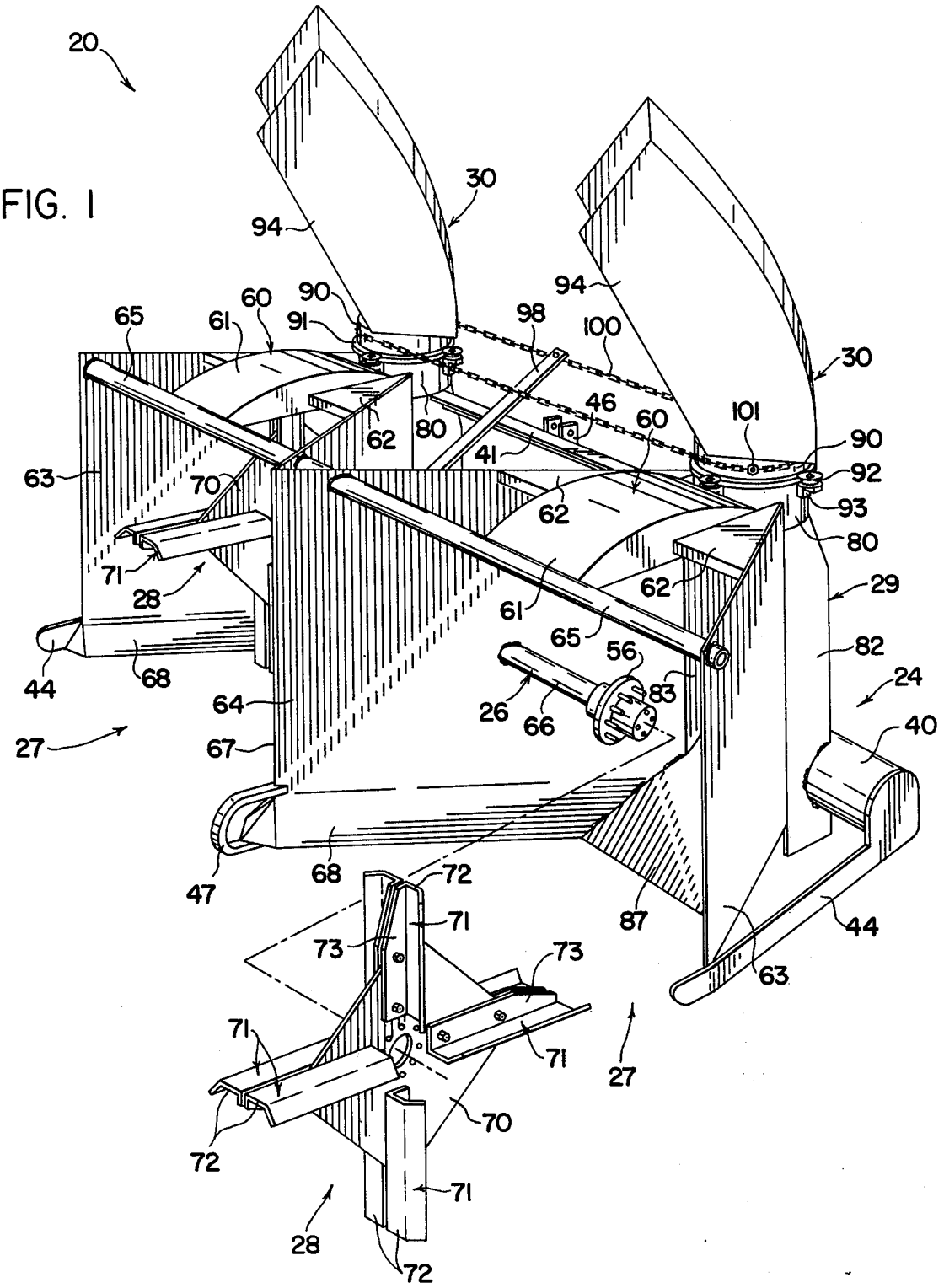
FIG. 1 is a perspective exploded view showing components of the roadway snow or ice excavator according to the invention.

A roadway snow excavation or removal apparatus according to the invention is referred to generally by the numeral 20. The apparatus 20 is attached to and powered by a vehicle referred to generally by the numeral 21. As shown (FIG. 2), the vehicle 21 is a conventional farm tractor, but could be any other type of propelled vehicle, wheeled or tracked or otherwise. The vehicle 21 will have thereon a conventional independently controlled and generally medial and longitudinally extending power take-off unit (PTO) indicated at 22. The apparatus 20 will be selectively attached to the frame (not shown) of a vehicle 21 as by conventional longitudinally directed push beams indicated at 23. If desired, the vehicle 21 may be provided with appropriate means (not shown) for raising and lowering the push beams 23 with the apparatus connected thereto relative to the plane of the roadway (not shown) covered by a mass of deep or packed snow or ice requiring of excavation or removal.

The primary component of the apparatus 20 is a frame referred to generally by the numeral 24. The frame 24 has structurally integrated elements for housing and carrying the other components of an apparatus 20, including a conventional power transmission system referred to generally by the numeral 25 and adapted for connection to the vehicle PTO unit 22. The transmission 25 powers an axle shaft indicated generally at 26. The axle shaft 26 extends into at least one snow and ice collector assembly referred to generally by the numeral 27 and carries thereon a rotatable paddle assembly referred to generally by the numeral 28. The collector assembly 27 and the paddle assembly 28 cooperatively and synergistically concentrate and move the mass of snow and ice on the roadway into a vertically oriented chute referred to generally by the numeral 29. Thereafter, the paddle assembly 28 and the chute 29 cooperatively and synergistically propel the mass of snow and ice taken up from the roadway into a directional discharge chute assembly referred to generally by the numeral 30.

The Frame 24

The frame 24 of an apparatus 20 is a structurally integrated unit comprising lower and upper transverse members, vertically oriented interconnecting members and forwardly directed outside base members. As shown, the lower transverse member 40 may be a length of cylindrical steel tubing for strength and durability. The upper transverse member 41 may be a shorter length of structural steel channel extending between, and securely attached to, elements of the vertically oriented chute 29. The vertically oriented members 42 may be pairs of steel web plates having upper and lower ends suitably shaped for secure attachment to conforming surfaces on the transverse members 40 and 41. The medial portion of each pair of web members 42 may be suitably drilled to receive a fastening pin 43 for connection of a vehicle push beam 23. The forwardly directed outside base members 44 are steel plates and suitably shaped to interconnect an end of the lower transverse member 40 to the front lower corner of a collector assembly 27. The under surface of a base member 44 may also provide a rail or guide 45 facilitating movement of the apparatus 20 on the surface of a roadway.

A frame 24 may also have a medial bracket and pin assembly 46 attached to the upper channel 41 for connection of a vehicle push beam 23 or for holding the flexible drive shaft of the transmission 25 when the apparatus 20 is not attached to the vehicle 21. The underside of the frame 24 may also have a medial guide bar 47 extending rearwardly from the leading face of a dual collector assembly 27 and securely attached to the lower transverse member 40.

The Transmission 25 and Axle Shaft 26

The transmission 25 is conventional and known from the prior art having a flexible drive shaft 50 adapted for selective connection to the vehicle PTO unit 22. The gear case 51 houses a rotatable drive shaft 52 selectively coupled to the flexible shaft 50. The drive shaft 52 mounts a pinion gear 53 in meshing engagement with a bevel gear 54. The bevel gear 54 is keyed to a coupling 55 connecting the inner ends of dual transversely extending axle shafts 26.

As is known in the art, the PTO unit 22 of a farm tractor 21 has an output revolution rate which is relatively low; for example, 1000 rpm. The resultant torque applied to the rotatable drive shaft 52 is relatively high. It has been found that the reduction ratio between the pinion gear 53 and bevel gear 54 should be in the order of 4:1, so that revolution rate of the axle shafts 26 is quite low; for example, 250 rpm. It is an advantage of the apparatus 20 that the power or torque supplied from the vehicle PTO unit 22 will be utilized in an efficient and advantageous manner, particularly in contrast to prior art roadway snow excavators.

The outer end of a journaled axle shaft 26 projects into and terminates at substantially the center of the concentration chamber of a collector assembly 27 in a suitable hub 56 for secure attachment of a paddle assembly 28.

The Collector Assembly 27

The collector assembly 27 is functional when a vehicle 21 with an apparatus 20 thereon is slowly driven into a mass of deep or packed snow or ice on a roadway. A collector assembly 27 has a vertically oriented hopper-like configuration with a wide and open face and a narrow discharge passage. A concentration chamber in a collector assembly 27 is structurally defined by an upper plate and dual side plates providing substantially planar walls converging on the discharge passage. In actual operation of an apparatus 20, the lower plane of a collector assembly concentration chamber will be functionally defined by the surface of the roadway with packed snow or ice thereon.

As shown, each collector assembly 27 comprises an upper plate indicated generally at 60 having a curved longitudinally extending medial portion defining a guard or cover 61 for the upper portions of a rotatable paddle assembly 28. Adjacent the inner end of the guard portion 61, a cover plate 60 has generally triangular shaped wing portions 62 securely attached to the upper edges of the converging dual, outer and inner, side plates 63 and 64.

A collector assembly 27 may also have a stabilizer bar 65 extending transversely to interconnect the front upper corners of the side plates 63 and 64. The medial portion of a stabilizer bar 65 may also function as an attachment point for the front end of the guard portion 61 of a cover plate 60.

A suitable drilled hole in each inner side plate 64 will provide for secure attachment of a tubular sleeve 66 for a journaled axle shaft 26. In the preferred embodiment of an apparatus 20 as shown, the dual collector assemblies 27 interconnected by the stabilizing bar 65 will be further interconnected by the axle shaft sleeve 66. Secure attachment of the front edges of converging inner side plates 64, above the medial guide bar 47, will further interconnect and strengthen the elements of the collector assemblies 27 and also provide a vertically oriented leading edge 67 functioning to plow into hardened masses of snow or ice on the roadway.

It is preferred that the lower portion of each side plate 63 and 64 be directed inwardly, to define horizontally oriented angular surfaces 68 functioning to plow up hardened masses of snow or ice from the roadway.

The Paddle Assembly 28

When attached to the hub 56 of an axle shaft 26 and when rotating at a relatively low rpm, a paddle assembly 28 functionally bisects the concentration chamber of a collector assembly 27 in a cylindrical and vertically oriented plane. As shown, a paddle assembly 28 has a square hub plate 70 adapted for symmetric attachment to the axle shaft hub 56. It has been found that fabricating the hub plate 70 as a square from a steel plate, as distinguished from a circular form, reduces material costs. It is also thought that a square hub plate 70 may further improve the efficient and advantageous operation of an apparatus 20 by applying a shear force to a mass of snow or ice in the narrowing rearward quadrant of the concentration chamber in a collector assembly 27 as each side of the square hub plate 70 sequentially approaches the discharge passage into the vertically oriented chute 29.

Each corner of the square hub plate 70 has removably but securely attached thereto a pair of scoops or blades indicated generally at 71. A paddle scoop 71 may be a length of structural steel channel suitably shaped to provide a leading edge 72 for applying a shear force to a packed mass of snow or ice on the roadway. A paddle scoop 71 has a body portion 73 suitably shaped to provide radially oriented surfaces of sufficient length and width as to move snow or ice through the center of the concentration chamber of a collector assembly 27 and through the discharge passage into the vertically oriented chute 29.

Figure 6:
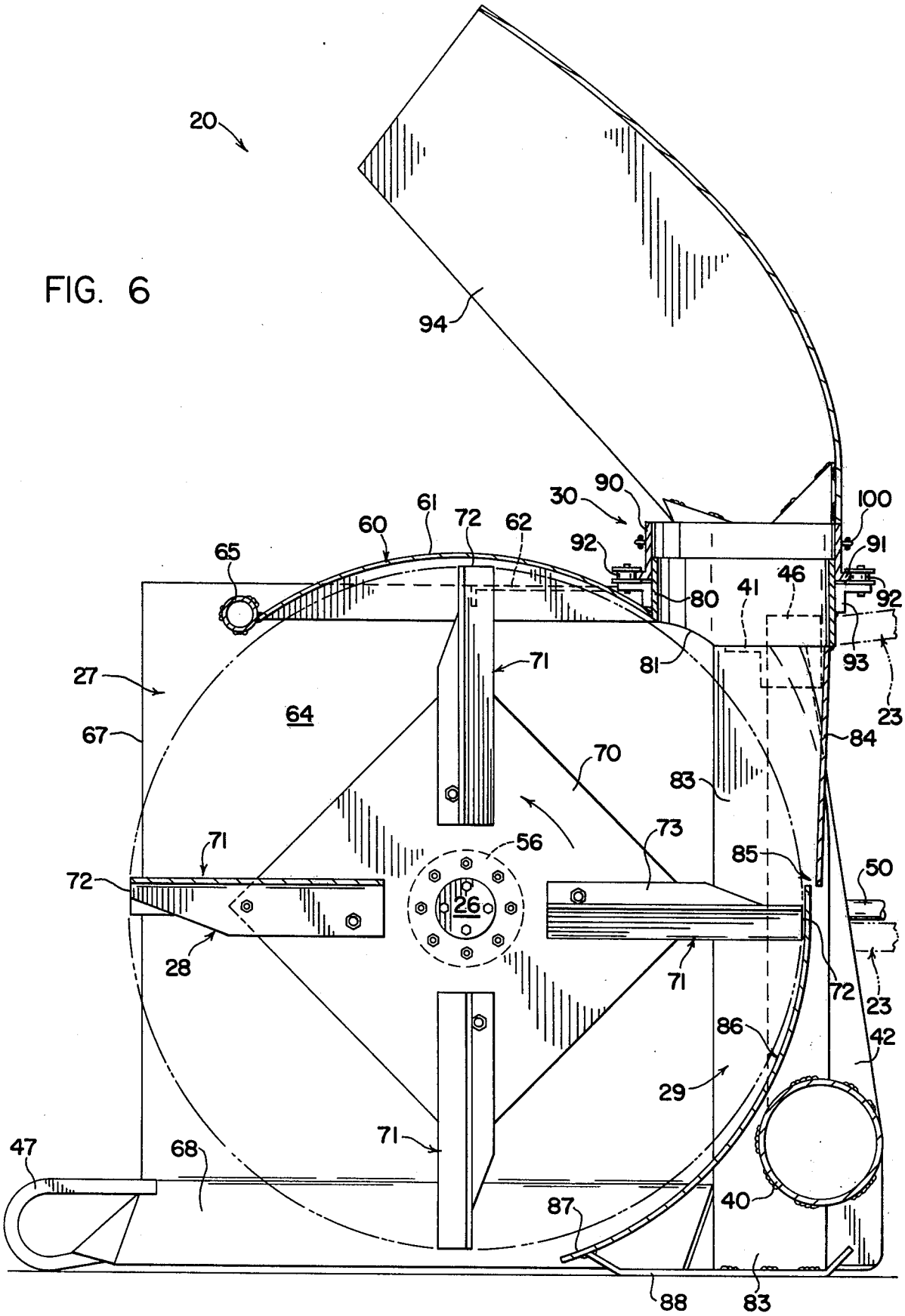
FIG. 6 is an enlarged cross-section taken substantially as indicated on line 6—6 of FIG. 3.

As shown by the chain line in FIG. 6, the effective diameter of the rotating paddle scoops 71 substantially coincides with the plane of the leading edge 67 of interconnected side plates 64. As further explained below, the effective diameter of the rotating paddle scoops 71 relative to the curved rear wall of a vertically oriented chute 29 has been found to be quite critical when the apparatus 20 is primarily intended for use in barnyards or on unimproved or secondary roadways.

The Vertically Oriented Chute

The vertically oriented chute 29 cooperates with the rotating paddle assembly 28 to propel the mass of snow or ice concentrated in the vertically oriented chamber of the collector assembly 27 up and into the directional discharge chute assembly 30. A vertically oriented chute 29 has an open upper end and parallel sides and a rear wall interconnected to define an elongated generally U-shaped conduit communicating with the discharge passage of a collector assembly 27 and the open upper end. The lower portion of the chute conduit has a width slightly in excess of the effective width of the scoops 71 on a paddle assembly 28.

The upper end of a chute 29 is formed by a stack ring 80 for connection to and mounting of the chute assembly 30. The stack ring 80 may be fabricated from a short annular length of steel tubing and be suitably shaped to provide a front area (indicated at 81 in FIGS. 6 and 7) for clearance by the rotating paddle scoops 71. The stack ring 80 is securely attached to the interconnected and suitably shaped upper ends of vertically oriented, upper and inner, steel side plates 82 and 83, and a steel upper rear wall plate 84. The upper ends of the inner side plates 83 are interconnected by secure attachment of the upper transverse frame member 41. The lower ends of the substantially parallel side plates 82 and 83 are suitably shaped for secure attachment to conforming surfaces on the lower transverse frame member 40. The outer edge of the side plate 82 is securely attached to the inner edge of the collector assembly side plate 63; the outer edge of the side plate 83 is securely attached to the inner edge of the collector assembly side plate 64. The lower edge of the upper rear wall plate 84 defines an outer edge of a horizontally oriented air passage or inlet slot indicated at 85.

Figure 7:
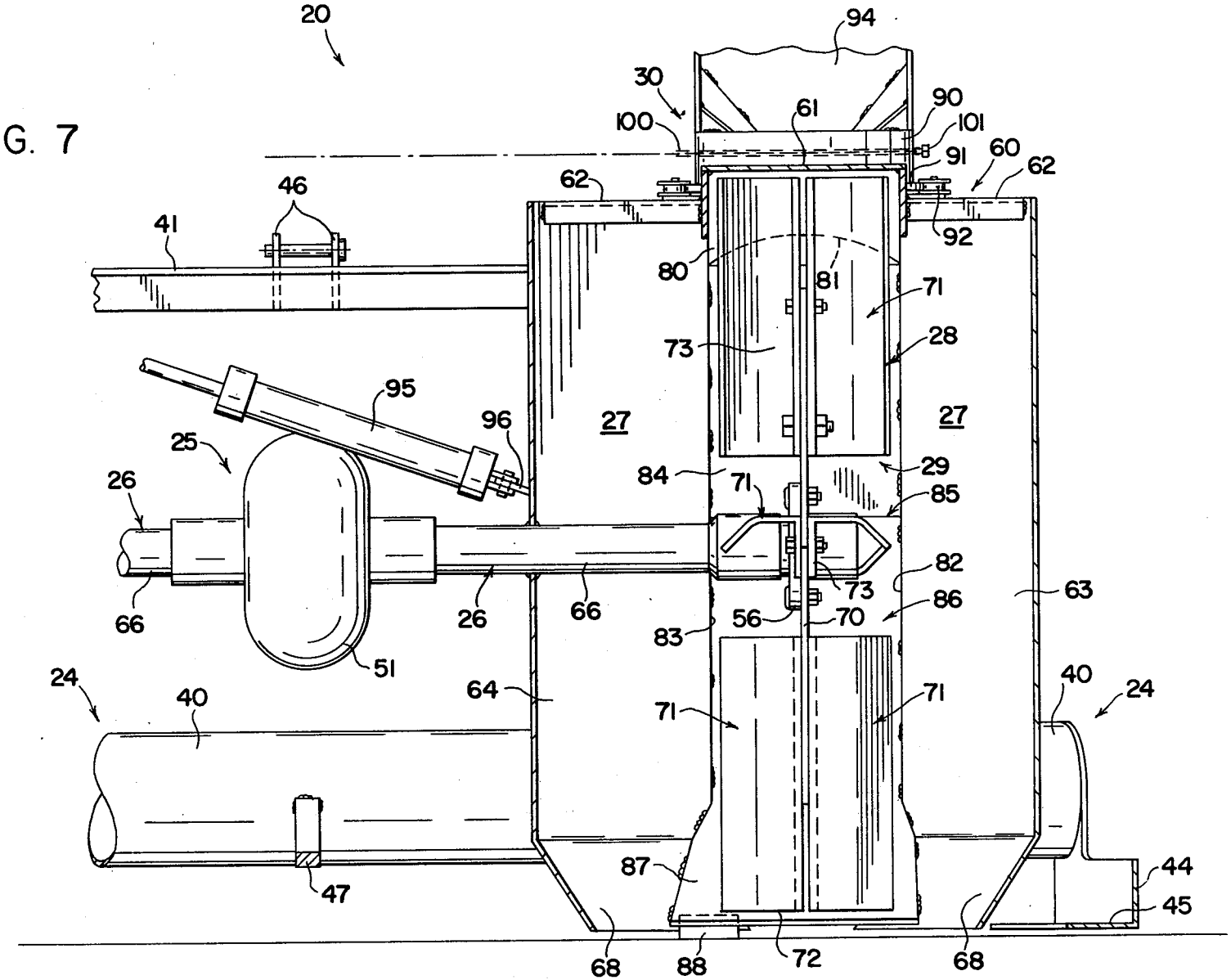
FIG. 7 is an enlarged front section taken substantially as indicated on line 7—7 of FIG. 2; and, FIG. 8 is an enlarged top section taken substantially as indicated on line 8—8 of FIG. 3.
Figure 8:
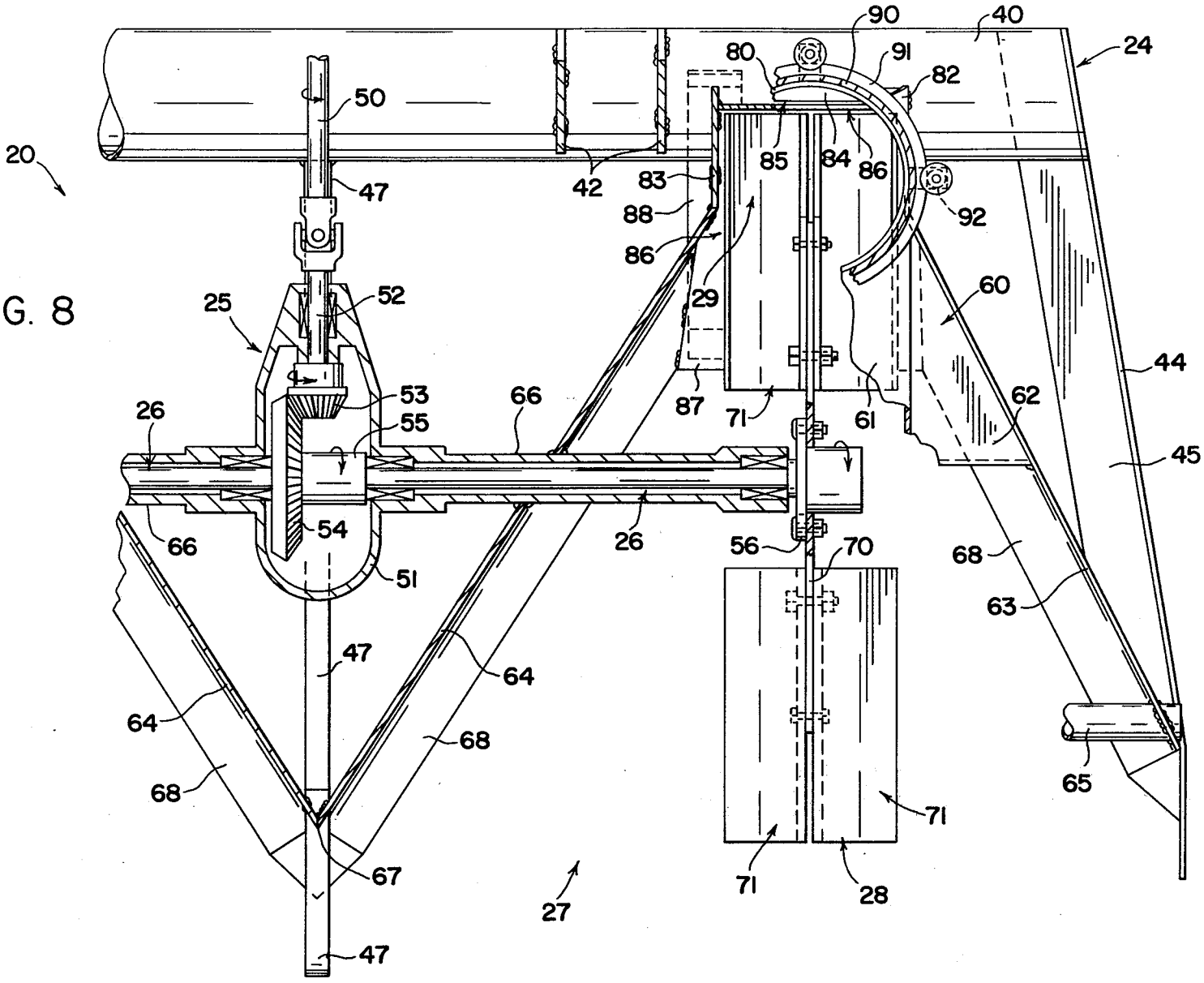

Specific reference is made to FIGS. 6 and 7 for the description of the element indicated at 86 and generally described as a curved steel plate having multiple operative functions.

The lower portion of a curved plate 86 projects into the concentration chamber of a collector assembly 27 and has edges securely attached to the lower ends of converging side plates 63 and 64 and to the angular plow surfaces 68 thereon. The plate 86 thus provides a leading edge and inclined surface 87 functioning to plow up hardened masses of snow or ice from the roadway. The lower end of an inner side plate 83 may have securely attached thereto a forwardly extending steel shoe 88 securely attached to the lower end of a plate 86. The shoe 88 will strengthen the plow surface 87 and also assist in movement of the apparatus 20 over the surface of a roadway. Rearwardly from the converging side plates 63 and 64 of the collector assembly 27, the parallel chute side plates 82 and 83 are interconnected by secure attachment to the edges of the upper portion of the curved plate 86 to define the lower portion of the rear wall of a chute 29. The upper edge of the curved plate 86 is positioned substantially coincident with the plane of the lower end of the upper rear wall plate 84 and spaced apart therefrom to define an inner edge of a horizontally oriented air passage 85.

Referring specifically to FIG. 6, the radius of the curved plate 86 is slightly eccentric to the effective diameter of the rotating paddle scoops 71 (as indicated by the chain line). As shown, the lower plate surface 87 is spaced radially of the paddle scoops 71 a predetermined distance; for example, of 0.75 inches. The upper plate surface adjacent the air slot 85 is spaced much closer to the paddle scoops 71; for example, 0.0625 inches. Therefore, the curved plate 86 may be further generally described as being positioned relative to the rotational axis of a paddle assembly 28 so as to define the plane of a cylindrical surface gradually converging toward the effective diameter of the paddle scoops 71. The dimensional feature just described should be utilized when the apparatus 20 is primarily intended for use in barnyards or on unimproved roads. It is thought that this feature will significantly reduce the likelihood of structural daage to a plate 86 or breakage of the scoops 71 in the event debris, gravel or wood, is embedded in the mass of snow or ice being excavated.

As shown in FIG. 6, the air slot 85 is positioned substantially coincident with a plane extending horizontally from the rotational axis of an axle shaft 26. This operating position for an air slot 85 is adjacent the point where snow or ice on the rotating paddle scoops 71 within the lower portion of a chute 29 becomes tangentially propelled toward the open end of the chute 29. It is thought that use of the air slot 85 in an apparatus 20 being used to remove packed snow and ice is quite critical. When the apparatus 20 is used to remove a normal snowfall, at relatively high vehicle speeds, it may be desirable to shield off or temporarily block the air slot 85 by a suitable element (not shown). However, the higher density or weight of a unit mass of packed snow or ice is such that effective delivery thereof from the chute 29 into the directional chute assembly 30 requires that the air slot 85 be open to atmosphere. When the chute 29 is intended for discharge into alternative conveying systems requiring a structural modification of the upper portion of a chute 29, the air slot 85 should always be positioned substantially adjacent the point where snow or ice on the rotating paddle scoops 71 becomes tangentially propelled.

The Directional Discharge Chute Assembly 30

A stack ring 80 at the upper end of a vertically oriented chute 29 may be used to coaxially mount a rotatable turret ring 90 forming the base element for a directional discharge chute assembly 30. A turret ring 90 may be fabricated from a short length of steel tubing and provided with an annular base flange 91. The base flange 91 may be movably engaged by a series of horizontally oriented sheaves 92 rotatably carried by mounting brackets 93 securely attached around the outside of a stack ring 80. A discharge chute 94 is securely mounted on each turret ring 90 and is suitably shaped to direct high volumes of snow or ice delivered through the vertically oriented chutes 29 to areas relatively far away from the vehicle 21.

Figure 2:
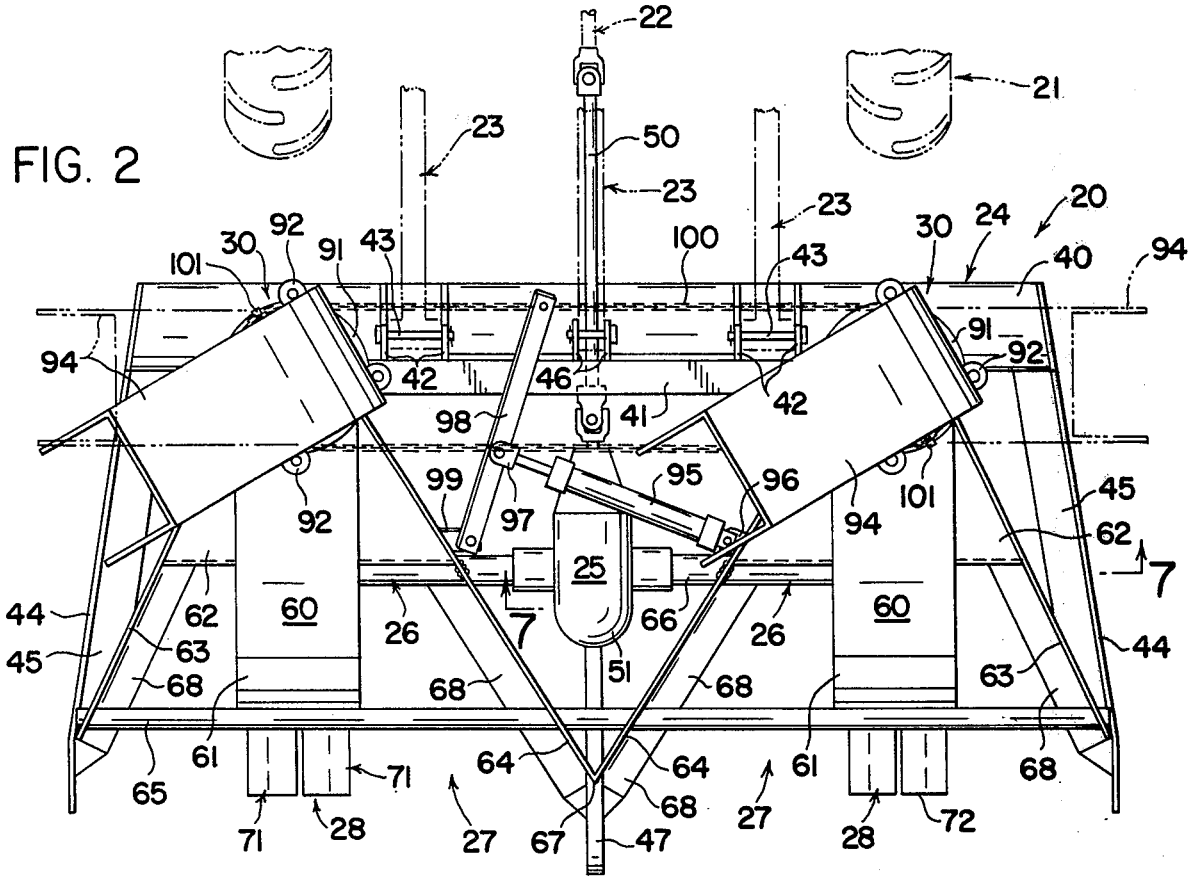
FIG. 2 is a top or plan view of the apparatus of FIG. 1.
Figure 3:
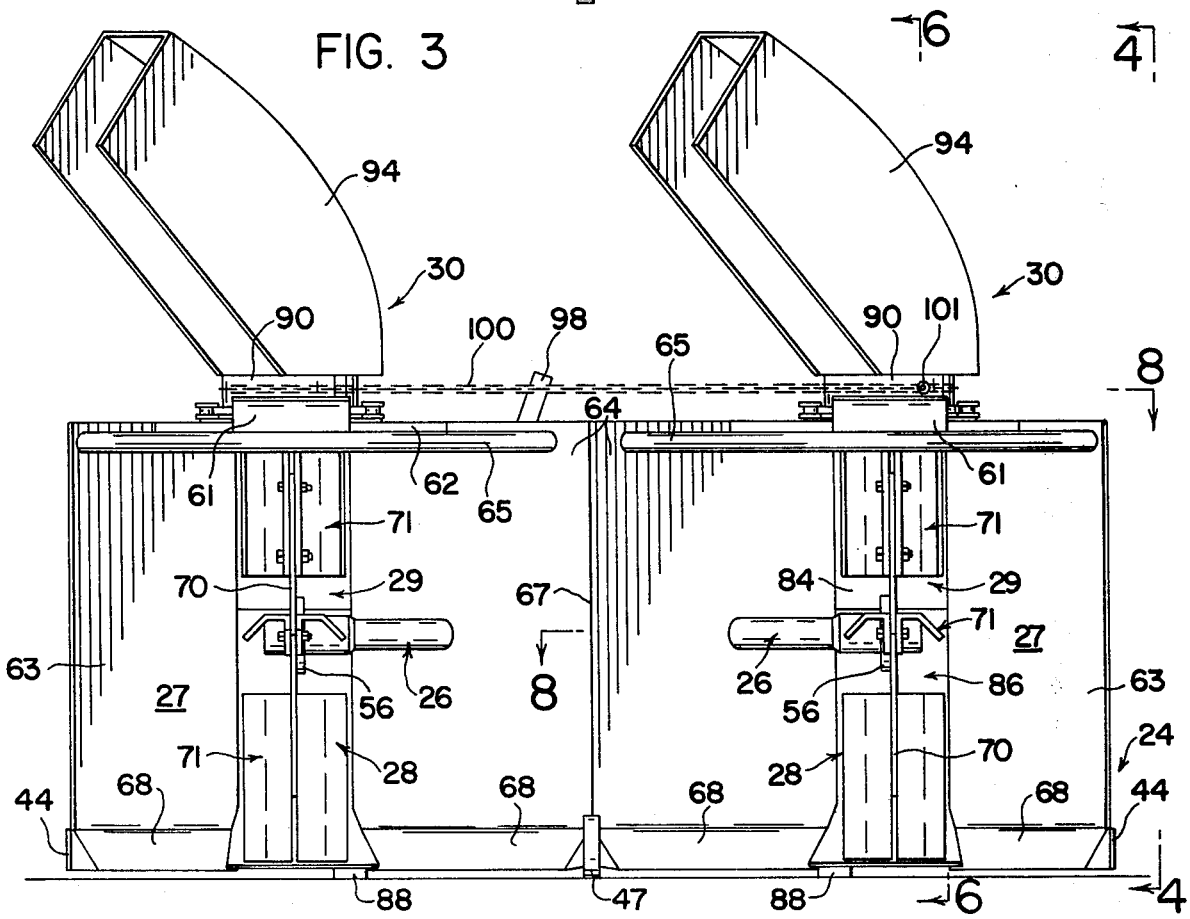
FIG. 3 is a front or elevational view of the apparatus of FIG. 1.
Figure 4:
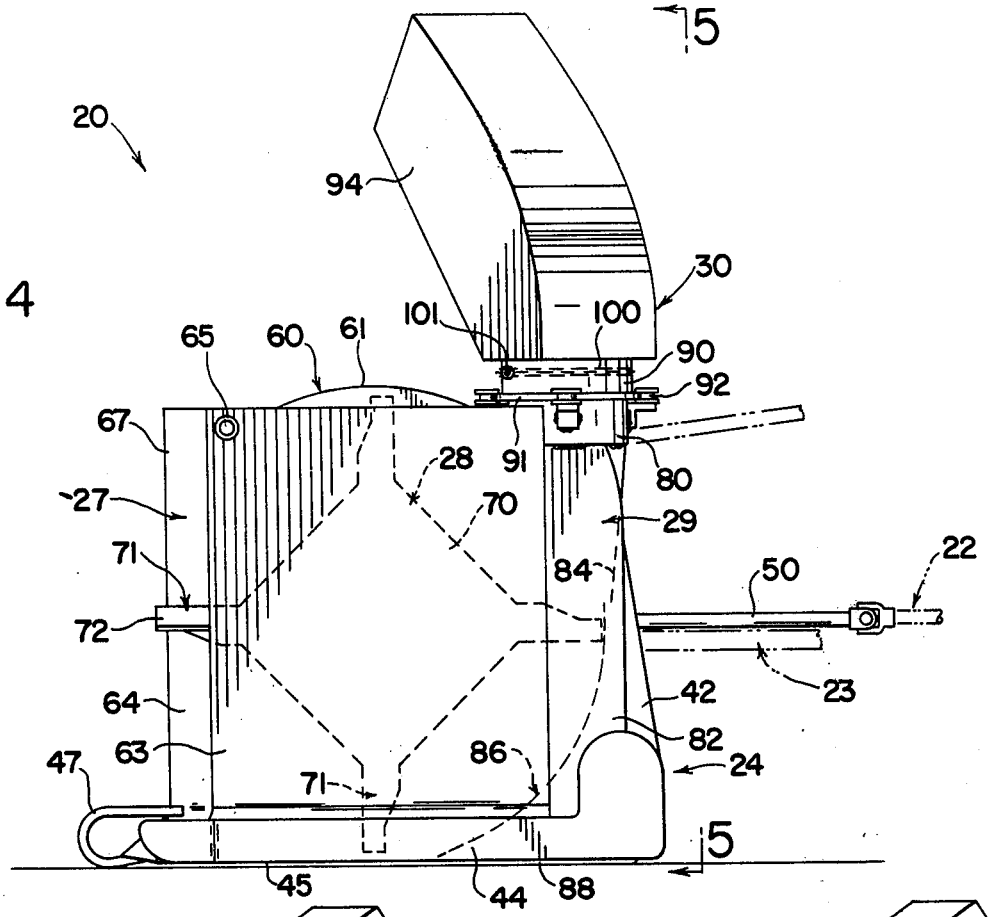
FIG. 4 is a side or elevational view taken substantially as indicated on line 4—4 of FIG. 3.
Figure 5:
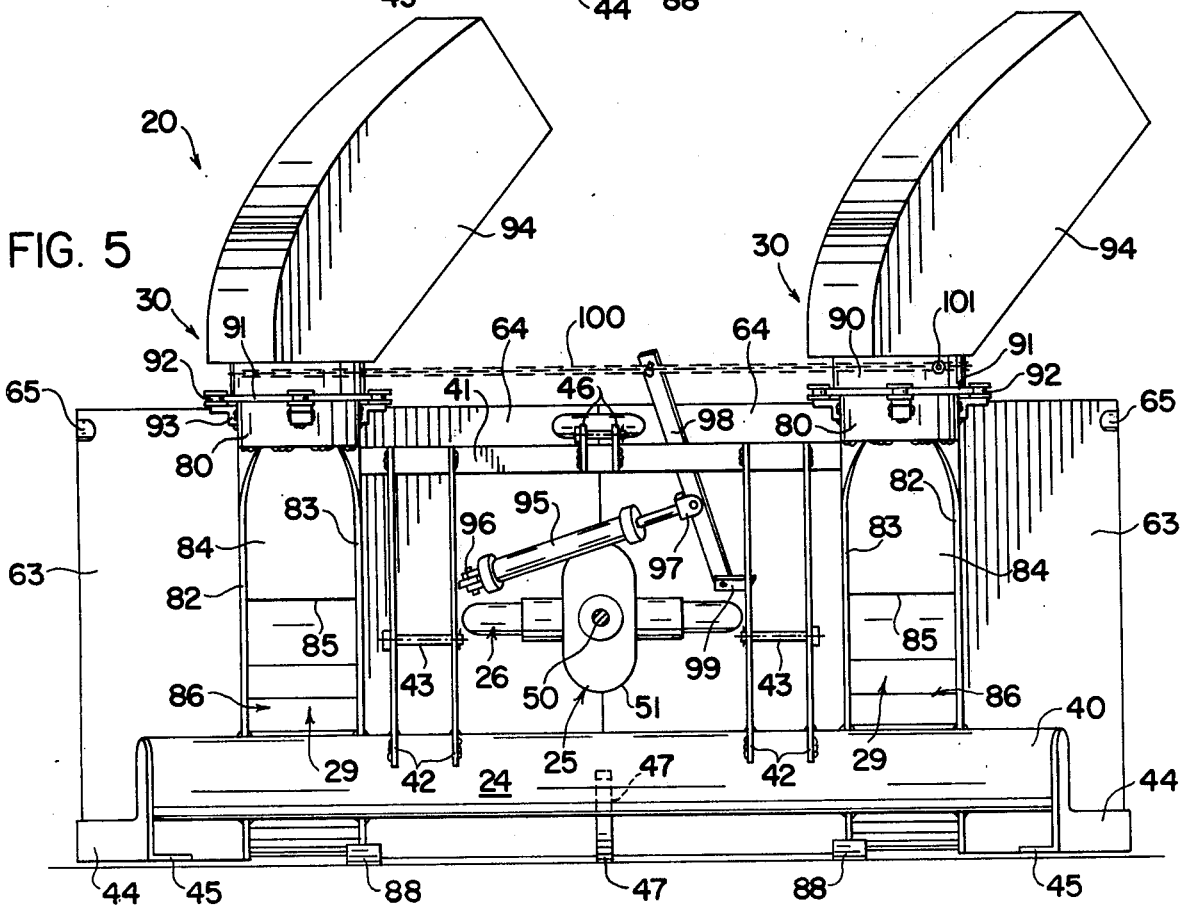
FIG. 5 is a rear or elevational view taken substantially as indicated on line 5—5 of FIG. 4.

The turret rings 90 may be selectively rotated to orient the discharge path for snow or ice from the chutes 94 by a remotely controlled means comprising a combination of elements, best shown in FIGS. 2 and 5. A double acting hydraulically operated piston 95 is base mounte by a clevis pin carried by a bracket 96 securely attached to the outside of one of the dual collector assembly inner side plates 64. The piston rod is mounted by a clevis bracket 97 to a mid point on a lever bar 98. The base of the lever bar 98 is mounted by a clevis pin carried by a bracket 99 securely attached to the outside of an opposite collector assembly inner side plate 64. The outer end of the lever bar 98 is securely connected to a segment of a continuous loop cable or link chain 100. Another segment of the chain 100 is securely connected, as indicated at 101, to each turret ring 90. The piston 95 may be selectively actuated from a conventional source (not shown) of hydraulic power so as to permit the operator of a vehicle 21 to control the discharge path from the dual funnels 94. The operator may also provide different discharge paths for each chute 94 (as shown by chain lines in FIG. 2) by varying the connection point 101 of a chain 100 relative to each turret ring 90.

What is claimed is:

1. A roadway snow or ice excavation apparatus to be carried by a vehicle having an appropriate power take-off unit, said apparatus having a frame and operating components including a power transmission system for connection to said vehicle power take-off unit and powering at least one axle shaft, said apparatus frame housing thereon at least one collector assembly having a vertically oriented hopper-like configuration with a wide and open face and a narrow discharge passage, a concentration chamber for snow or ice within said collector assembly being defined by an upper cover plate and dual side plates providing substantially planar walls converging on said discharge passage, said powered axle shaft projecting into said concentration chamber of the collector assembly through one of said side plates of the collector assembly and carrying thereon a paddle assembly which when rotating functionally bisects said concentration chamber in a cylindrical and vertically oriented plane, said paddle assembly having scoops thereon shaped to provide radially oriented surfaces of sufficient length and width as to move snow or ice through said discharge passage of the collector assembly and into a vertically oriented chute carried on said apparatus frame, said vertically oriented chute having an open upper end and parallel sides and a rear wall interconnected to define an elongated conduit communicating with said discharge passage of the collector assembly and said open upper end, the lower portion of said chute conduit having a width slightly in excess of the effective width of said scoops on the paddle assembly, said rear wall of the vertically oriented chute having an air slot positioned adjacent the point where snow or ice on the rotating scoops of the paddle assembly becomes tangentially propelled, said rear wall of the vertically oriented chute further having a curved plate with a lower portion projecting toward said collector assembly and an upper portion positioned to define an edge of said air slot, the radius of said curved plate being slightly eccentric to the effective diameter of said rotating scoops of the paddle assembly, said curved plate being further positioned so as to define the plane of a cylindrical surface gradually converging toward said effective diameter of the paddle scoops.

2. An apparatus according to claim 1, wherein said open upper end of the vertically oriented chute communicates with a directional discharge chute assembly.

3. An apparatus according to claim 1, wherein said apparatus frame is a structurally integrated unit comprising lower and upper transverse members, vertically oriented interconnecting members and forwardly directed outside members.

4. An apparatus according to claim 1, wherein said paddle assembly has a square hub plate adapted for symmetric attachment to said powered axle shaft and carrying sets of dual scoops thereon at the four corners thereof.

5. An apparatus according to claim 1, wherein said lower portion of the curved rear wall plate projects into said collector assembly and has edges interconnected with the lower ends of said converging collector assembly side plates to provide a leading edge and inclined surface functioning to plow up masses of packed snow or ice from the roadway.

6. Apparatus according to claim 2, wherein said open upper end of said vertically oriented chute is an annular stack ring coaxially mounting a rotatable turret ring forming the base element for said directional discharge chute assembly.

7. An apparatus according to claim 3, wherein said lower transverse frame member is a length of cylindrical steel tubing.

8. Apparatus according to claim 6, wherein said turret ring of a directional discharge chute assembly is selectively rotated to orient the discharge path for snow or ice by remotely controlled means.

* * * * *